US012698171B2

(12) United States Patent
Tokunaga et al.

(10) Patent No.: US 12,698,171 B2
(45) Date of Patent: Aug. 4, 2026

(54) SHEET FEEDING APPARATUS AND IMAGE FORMING APPARATUS

(71) Applicant: CANON KABUSHIKI KAISHA, Tokyo (JP)

(72) Inventors: Hiroki Tokunaga, Kanagawa (JP); Misaki Shiozawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/894,853

(22) Filed: Sep. 24, 2024

(65) Prior Publication Data

US 2025/0108989 A1 Apr. 3, 2025

(30) Foreign Application Priority Data

Sep. 29, 2023 (JP) ..... 2023-169938

(51) Int. Cl.
*B65H 5/22* (2006.01)
*B65H 7/16* (2006.01)

(52) U.S. Cl.
CPC ..... *B65H 5/228* (2013.01); *B65H 7/16* (2013.01); *B65H 2301/4461* (2013.01)

(58) Field of Classification Search
CPC .. B65H 5/228; B65H 7/16; B65H 2301/4461; B65H 3/08; B65H 3/0808; B65H 3/0883
See application file for complete search history.

(56) References Cited

U.S. PATENT DOCUMENTS

2009/0283958 A1* 11/2009 Takahashi ..... B65H 3/128 271/11
2020/0095080 A1* 3/2020 Tsuno ..... B65H 29/245

FOREIGN PATENT DOCUMENTS

JP 2006256819 A 9/2006
JP 2007238239 A 9/2007

* cited by examiner

*Primary Examiner* — Thomas A Morrison
(74) *Attorney, Agent, or Firm* — Canon U.S.A., Inc. IP Division

(57) ABSTRACT

A sheet feeding apparatus includes a support portion; a feed unit; an air blowing unit including an air blowing portion, a first air outlet, and a second air outlet; and a control unit, wherein the first air outlet is disposed to blow the air in a case where the sheet is a first sheet or a second sheet shorter than the first sheet, wherein the second air outlet is disposed to blow the air in a case where the sheet is the first sheet, and wherein in a case where the sheet is the first sheet, the control unit controls the amount of fan airflow to a first airflow, whereas in a case where the sheet is the second sheet, the control unit controls the amount of the fan airflow to a second airflow larger than the first airflow.

12 Claims, 6 Drawing Sheets

FIG. 6A

SHEET LENGTH: LESS THAN OR EQUAL TO 148.5 mm

| TARGET | GRAMMAGE [ g/m$^2$ ] | DUTY RATIO [%] | | |
|---|---|---|---|---|
| | | HH | NN | NL |
| SHEET A | TO 163 | 0 | 0 | 0 |
| SHEET B | 164 TO 220 | 0 | 0 | 0 |
| SHEET C | 221 TO 256 | 0 | 0 | 0 |

FIG. 6B

SHEET LENGTH: 148.6 mm TO 215.9 mm

| TARGET | GRAMMAGE [ g/m$^2$ ] | DUTY RATIO [%] | | |
|---|---|---|---|---|
| | | HH | NN | NL |
| SHEET A | TO 163 | 100 | 40 | 0 |
| SHEET B | 164 TO 220 | 100 | 60 | 0 |
| SHEET C | 221 TO 256 | 100 | 60 | 0 |

FIG. 6C

SHEET LENGTH: 216 mm TO 457.2 mm

| TARGET | GRAMMAGE [ g/m$^2$ ] | DUTY RATIO [%] | | |
|---|---|---|---|---|
| | | HH | NN | NL |
| SHEET A | TO 163 | 80 | 40 | 0 |
| SHEET B | 164 TO 220 | 80 | 40 | 0 |
| SHEET C | 221 TO 256 | 80 | 40 | 0 |

SHEET FEEDING APPARATUS AND IMAGE FORMING APPARATUS

BACKGROUND

Field of the Disclosure

Some embodiments of the present disclosure relate to a sheet feeding apparatus configured to feed sheets and an image forming apparatus using the sheet feeding apparatus.

Description of the Related Art

In recent years, there has been a demand for higher quality of output image products from electrophotographic image forming apparatuses, such as copy machines, printers, and facsimiles. For this type of image forming apparatuses, not uncoated plain paper but specialty paper, for example, glossy coated paper with its surface coated with a coating agent, is called for in order to produce higher image quality products.

A manual feed apparatus attached to one side of an image forming apparatus is often used to feed specialty paper. The manual feed apparatus is provided with a tray for placing sheets, and is capable of feeding various-sized sheets (long paper sheets, irregularly-sized paper sheets, and small-sized paper sheets) that cannot be stored in cassette feed apparatuses in the image forming apparatus and highly-rigid thick paper sheets that cannot be conveyed due to their high conveyance resistance.

Japanese Patent Application Laid-Open No. 2006-256819 discusses a sheet feeding apparatus including an air-assisted separation apparatus. When a plurality of sheets of coated paper is set on a tray, the air-assisted separation apparatus blows air to one side of the sheets in a width direction substantially perpendicular to the sheet feeding direction, allowing the sheets in a bundle to be separated. The air-assisted separation apparatus blows air into the side through the bundle of sheets to reduce the adhesion between the sheets.

Further, Japanese Patent Application Laid-Open No. 2007-238239 discusses an air-assisted separation apparatus configured to blow air with an optimal airflow based on the type, size, and the remaining quantity of sheets stacked on the tray.

However, Japanese Patent Application Laid-Open No. 2007-238239 does not disclose the amount of fan airflow of the sheet feeding apparatus to sheets with different lengths in the sheet feed direction. A too large amount of fan airflow can cause excessive operating noise and/or power consumption. In contrast, when the amount of fan airflow is too low, it can be difficult to sufficiently separate the sheets in a bundle.

SUMMARY

Some embodiments of the present disclosure are directed to providing a sheet feeding apparatus configured to set appropriate amounts of fan airflow for sheets with different lengths in a feed direction, and an image forming apparatus.

According to an aspect of the present disclosure, a sheet feeding apparatus includes a support portion configured to support a sheet, a feed unit configured to feed the sheet supported by the support portion, an air blowing unit including an air blowing portion configured to blow air, a first air outlet configured to blow the air blown from the air blowing portion in a width direction to the sheet supported by the support portion, and a second air outlet disposed upstream of the first air outlet in a feed direction and configured to blow the air blown from the air blowing portion in the width direction to the sheet supported by the support portion, and a control unit configured to control an amount of fan airflow from the air blowing portion in executing air blowing by the air blowing unit, wherein the first air outlet is disposed to blow the air to the sheet in a case where the sheet supported by the support portion is a first sheet or a second sheet shorter than the first sheet in the feed direction, wherein the second air outlet is disposed to blow the air to the sheet in a case where the sheet supported by the support portion is the first sheet, and wherein in a case where the sheet supported by the support portion is the first sheet, the control unit controls the amount of fan airflow from the air blowing portion to a first airflow in executing air blowing by the air blowing unit, whereas in a case where the sheet supported by the support portion is the second sheet, the control unit controls the amount of the fan airflow from the air blowing portion to a second airflow larger than the first airflow in executing air blowing by the air blowing unit.

According to another aspect of the present disclosure, an image forming apparatus includes the sheet feeding apparatus and an image forming unit configured to form images on sheets fed from the sheet feeding apparatus.

Further features of various embodiments will become apparent from the following description of exemplary embodiments with reference to the attached drawings.

BRIEF DESCRIPTION OF THE DRAWINGS

FIG. 6A is a table for setting the amount of fan airflow based on a sheet grammage and environment conditions in a case where the sheet length is less than or equal to 148.5 mm.

FIG. 6B is a table for setting the amount of fan airflow based on the sheet grammage and environment conditions in a case where the sheet length falls within the range between 148.6 mm and 215.9 mm.

FIG. 6C is a table for setting the amount of fan airflow based on the sheet grammage and environment conditions in a case where the sheet length falls within the range between 216 mm and 457.2 mm.

DESCRIPTION OF THE EMBODIMENTS

Figure 1:
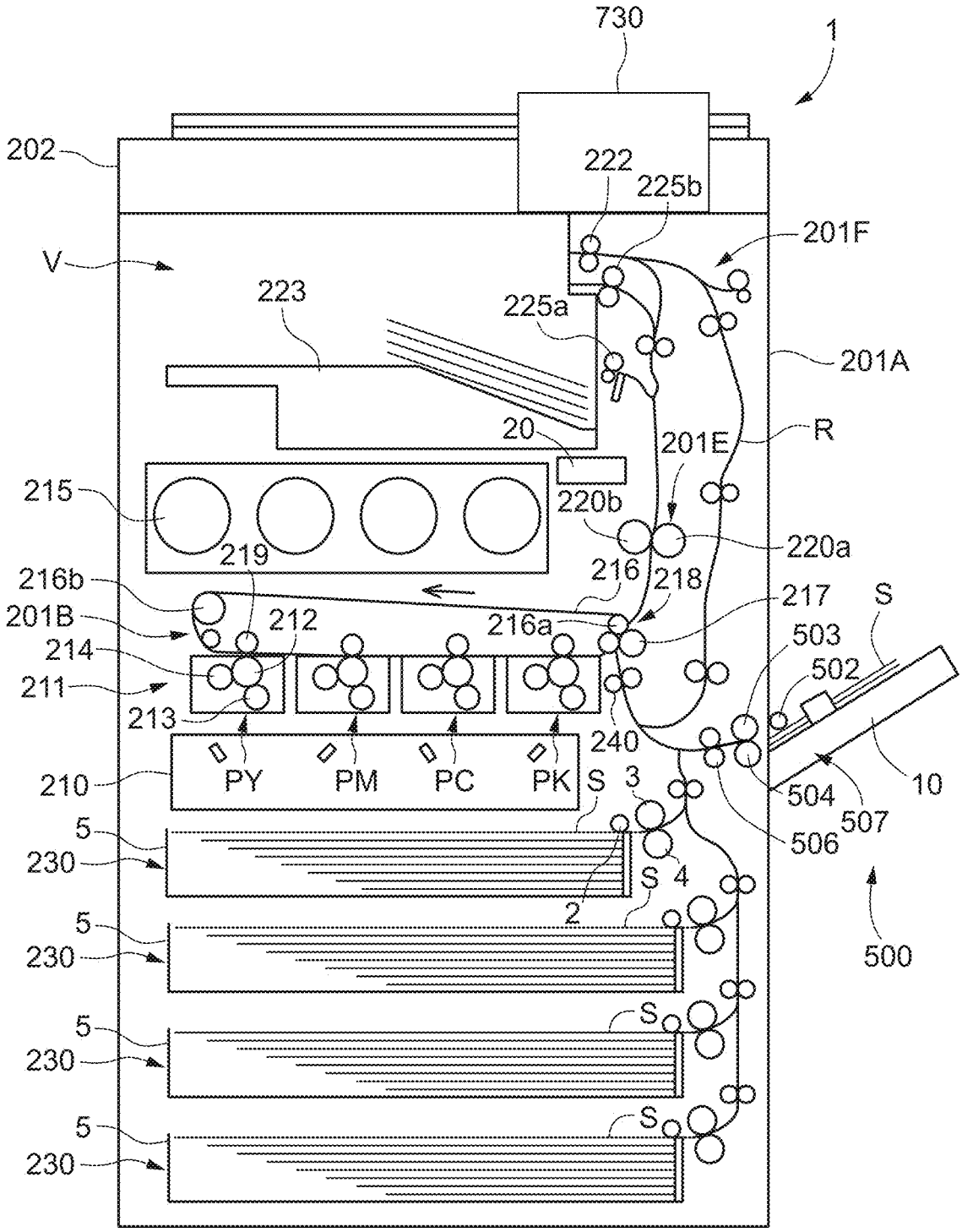
FIG. 1 is a cross-sectional view illustrating an image forming apparatus according to an exemplary embodiment.
Figure 2:
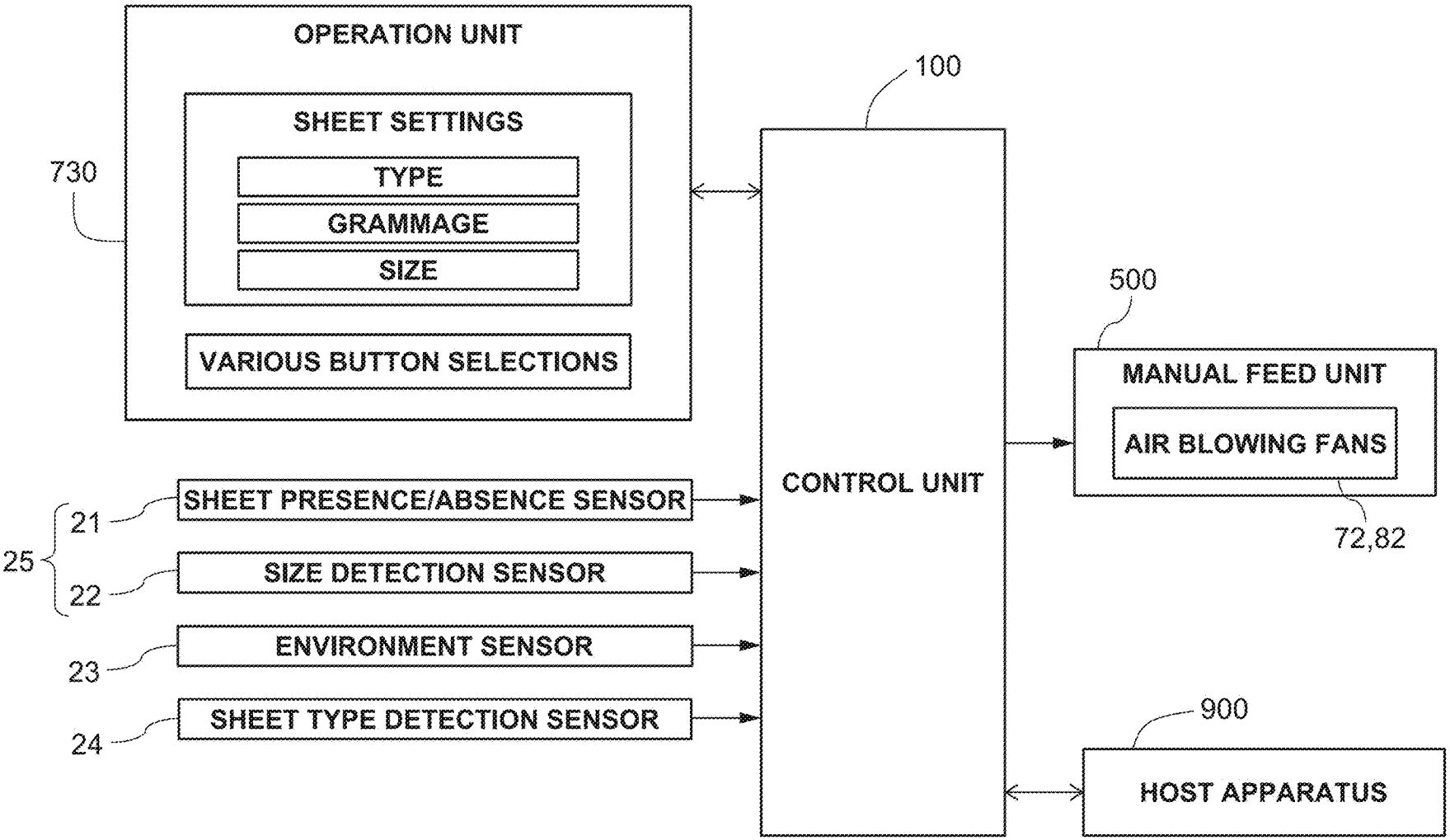
FIG. 2 is a block diagram illustrating a control system of the image forming apparatus according to the exemplary embodiment.

An exemplary embodiment will now be described with reference to the drawings. The schematic configuration of an image forming apparatus 1 according to the present exemplary embodiment will be described with reference to FIGS. 1 and 2. FIG. 1 is a cross-sectional view illustrating the schematic configuration of the image forming apparatus 1 according to the present exemplary embodiment, and FIG. 2 is a block diagram illustrating a control system. The image forming apparatus 1 is a laser beam printer that employs a tandem intermediate transfer method with an electrophotographic process. The image forming apparatus 1 forms and outputs a full-color or single-color image corresponding to print image data output from a host apparatus 900 connected to a control unit 100, on a sheet S as a recording medium.

As illustrated in FIG. 2, the control unit 100 is a control unit that generally controls operations of the image forming apparatus 1, and transmits and receives information to and from the host apparatus 900 and an operation unit 730. Further, the control unit 100 processes signals for various processing devices and performs sequence controls. The host apparatus 900 is, for example, a personal computer, an image scanner, or a facsimile.

The control unit 100 includes a central processing unit (CPU), a random access memory (RAM), and a read-only memory (ROM) and controls internal components of the image forming apparatus 1. The CPU outputs output signals to electrical components based on detection signals input from various sensors and information stored in the ROM to cause the electrical components to operate at desired timings with required control amounts. Thus, the CPU is responsible for controlling the electrical components. The ROM and the RAM store information for controlling components, and the CPU reads and writes information data stored in the ROM and to the RAM, respectively. The control unit 100 controls the amount of fan airflow from air blowing fans 72 and 82 during an air-assisted separation with a first air-assisted separation unit 74 and a second air-assisted separation unit 84 of a manual feed unit 500 described below.

As illustrated in FIG. 1, the image forming apparatus 1 includes an apparatus body 201A and an image forming unit 201B configured to form an image on a sheet S. An image reading apparatus 202 is installed substantially horizontally over the apparatus body 201A. A discharge space V for sheet discharge is formed between the image reading apparatus 202 and the apparatus body 201A. The image forming apparatus 1 includes cassette feed units 230 at its lower part, and the manual feed unit 500 at its central position on one side.

The cassette feed units 230 each feed sheets S from the corresponding feed cassette 5. The feed cassettes 5 are sheet storage units storing the sheets S. Each cassette feed unit 230 includes a pickup roller 2 and a pair of separation rollers. The pickup roller 2 conveys the sheets S stored in the corresponding feed cassette 5. The pair of separation rollers consists of a feed roller 3 and a retard roller 4 for separating the sheets S discharged from the pickup roller 2.

The manual feed unit 500 feeds sheets S on a manual feed tray 10. The manual feed tray 10 is an example of a support portion that supports the sheets S. The manual feed unit 500 is an example of a sheet feeding apparatus and, similarly to the cassette feed units 230, includes a pickup roller 502 for conveying the sheets S placed on the manual feed tray 10. According to the present exemplary embodiment, the manual feed tray 10 is configured to be opened or closed by being pivoted relative to the apparatus body 201A as an example of a housing, is moved between its opened and closed positions, and supports the sheets S at the opened position. Further, the apparatus body 201A includes a pair of separation rollers for separating the sheets S conveyed via the pickup roller 502, and the pair of separation rollers consists of a feed roller 503 and a retard roller 504.

The image forming unit 201B forms an image on a sheet S conveyed from one of the cassette feed units 230 or the manual feed unit 500. The image forming unit 201B employs a four-drum full-color method, and includes a laser scanner 210 and four process cartridges 211 for forming toner images in four colors that are yellow (Y), magenta (M), cyan (C), and black (K). Each process cartridge 211 includes a photosensitive drum 212, a charging device 213 as a charging unit, and a development device 214 as a development unit. Further, the image forming unit 201B includes a secondary transfer portion 218 and a fixing unit 201E above the process cartridges 211. Toner cartridges 215 supply toner to the development devices 214.

The secondary transfer unit 218 includes a transfer belt 216 wound around a drive roller 216*a* and a tension roller 216*b*. Primary transfer rollers 219 in contact with the transfer belt 216 are provided inside the transfer belt 216 and at opposite positions to the photosensitive drums 212. The transfer belt 216 is rotated in an arrow direction via the drive roller 216*a* driven by a drive unit. Secondary transfer rollers 217 are disposed at opposite positions to the drive roller 216*a* of the secondary transfer unit 218 and transfer color images formed on the transfer belt 216 to a sheet S.

The fixing unit 201E is disposed above the secondary transfer rollers 217, and a pair of first discharge rollers 225*a* and a pair of second discharge rollers 225*b* for sheet discharge are disposed above the fixing unit 201E. Further, a two-sided reversal portion 201F for sheet reversal is disposed above the second discharge rollers 225*b*. The two-sided reversal unit 201F is provided with a pair of reverse rollers 222 and a re-conveying path R. The pair of reverse rollers 222 can rotate forward and backward, and a sheet S with an image formed on one side is conveyed to the image forming unit 201B again through the re-conveying path R. The operation unit 730 for receiving user operations is provided on top of the image forming apparatus 1. The operation unit 730 employs a touch panel method with a display function and an input function.

An image forming operation of the image forming apparatus 1 will now be described. The image forming apparatus 1 receives image data for a document to be printed, and the image information is subjected to image processing. Then, the processed information is converted into an electric signal, and the electric signal is transmitted to the laser scanner 210 of the image forming unit 201B. In the image forming unit 201B, surfaces of the photosensitive drums 212 charged uniformly to a predetermined polarity and a predetermined potential by the charging device 213 are laser-exposed sequentially. This sequentially forms yellow, magenta, cyan, and black electrostatic latent images on the photosensitive drums 212 of the process cartridges 211.

The electrostatic latent images are developed with the toners in respective colors to be visualized, and the toner images in the respective colors on the photosensitive drums 212 are sequentially transferred and overlaid one another on the transfer belt 216 using primary transfer biases applied to the primary transfer rollers 219. Consequently, toner images are formed on the transfer belt 216.

Further, concurrently with the toner image forming operation, a sheet S is singly conveyed from one of the cassette feed units 230 or the manual feed unit 500 to a pair of registration rollers 240. At the pair of registration rollers 240, the leading edge of the sheet S comes into contact with a nip portion of the pair of registration rollers 240 to form a loop in the sheet S, and a skew of the leading edge of the sheet S is corrected. Upon the sheet skew correction, the sheet S is conveyed to the secondary transfer portion 218 at a predetermined timing by the pair of registration rollers 240, and the toner images are transferred collectively to the sheet S at the secondary transfer portion 218 using a secondary transfer bias applied to the secondary transfer rollers 217.

The sheet S with the transferred toner images thereon is conveyed to the fixing unit 201E and receives heat and pressure at a roller nip portion between a pressing roller 220*a* and a heating roller 220*b* that melt and mix the toners in the respective colors, and the color image is fixed to the sheet S. The sheet S with the fixed image thereon is discharged into the discharge space V via the pair of first discharge rollers 225*a* or the pair of second discharge rollers 225*b* disposed downstream of the fixing unit 201E, and the discharged sheet S is stacked neatly on a discharge tray 223 extending at the bottom of the discharge space V. In two-sided image forming, the image is fixed on one side of the sheet S, and the sheet S is conveyed to the re-conveying path R via the pair of reverse rollers 222 and to the image forming unit 201B again.

[Manual Feed Unit]

Figure 3:
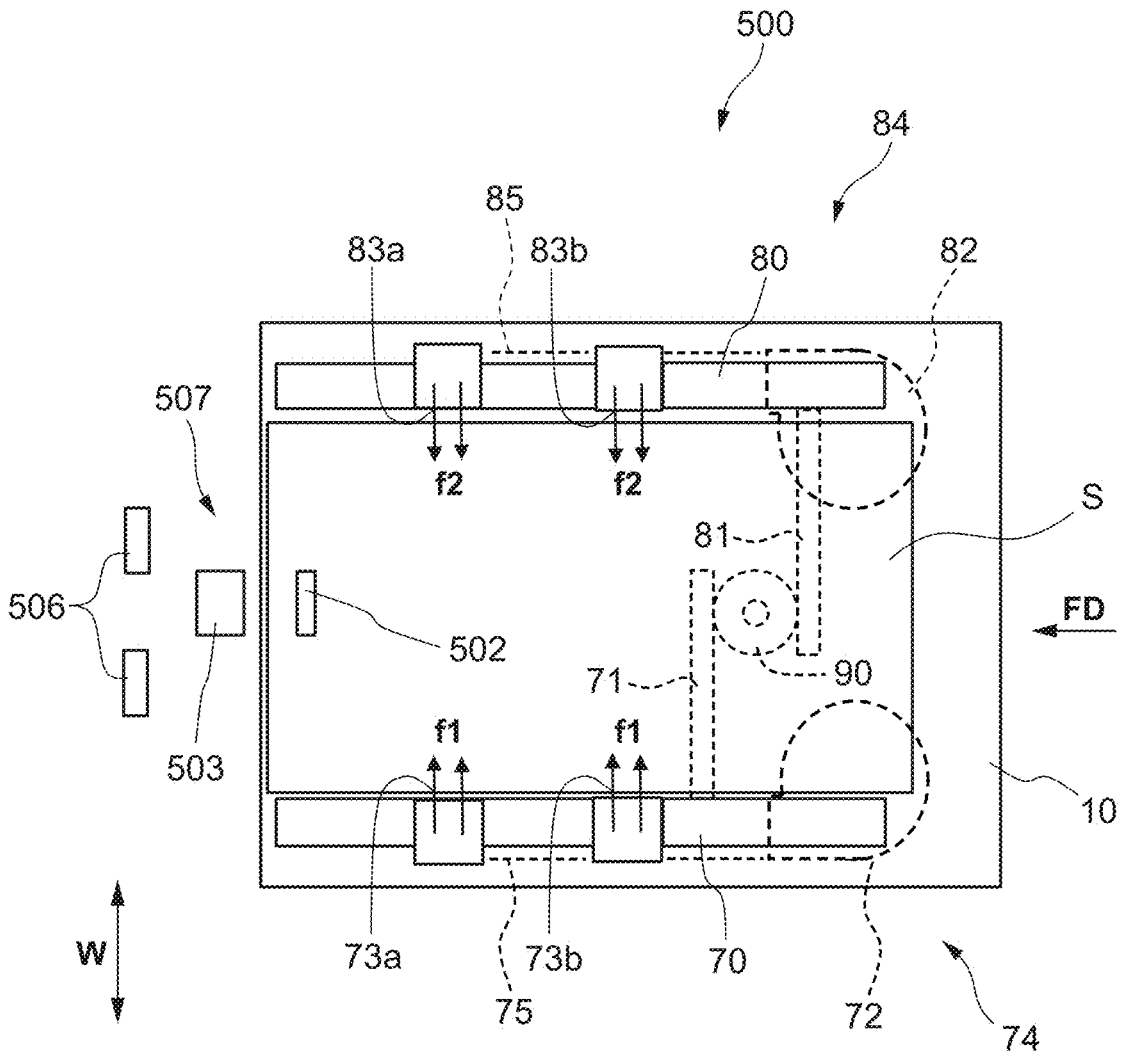
FIG. 3 is a plan view illustrating a state where A3-sized sheets are stacked on a manual feed unit according to the exemplary embodiment.

The manual feed unit 500 will now be described with reference to FIGS. 3 and 4. As illustrated in FIG. 3, the manual feed unit 500 includes the manual feed tray 10, the pickup roller 502, and a pair of a first side regulation unit 70 and a second side regulation unit 80.

The pickup roller 502 is an example of a feed portion and feeds a sheet S supported by the manual feed tray 10. While the pickup roller 502 configured to be brought into contact with a sheet and feed the sheet is applied as the feed portion according to the present exemplary embodiment, this is not a limitation and, for example, air-assisted sheet feeding can be performed.

The manual feed unit 500 is provided with a sheet presence/absence sensor 21 and a size detection sensor 22 (refers to FIG. 2). The sheet presence/absence sensor 21 is disposed, for example, downstream of the manual feed tray 10 in a feed direction FD, and when the sheet S is stacked on the manual feed tray 10, the sheet presence/absence sensor 21 generates a signal and transmits the signal to the control unit 100. This enables the control unit 100 to detect the placement of the sheet S regardless of the size. The size detection sensor 22 is disposed, for example, upstream of the sheet presence/absence sensor 21 in the feed direction FD. Thus, while an A3-sized sheet illustrated in FIG. 3 is detected and a signal is generated and transmitted to the control unit 100, an A4-sized sheet illustrated in FIG. 4 is not detected and no signal is generated. This enables the control unit 100 to identify whether the placed sheet S is A3-sized or A4-sized using the size detection sensor 22.

Further, the size detection sensor 22 is also disposed at a position where the position of the first side regulation unit 70 in a width direction W of a placed sheet is detectable. This makes it possible to detect the size of the placed sheet S in the width direction W. According to the present exemplary embodiment, the sheet presence/absence sensor 21 and the size detection sensor 22 are an example of a sheet detection unit 25. The sheet detection unit 25 is configured to detect a sheet S supported by the manual feed tray 10 and output the detection result that varies based on whether the detected sheet S is an A3-sized sheet or an A4-sized sheet. According to the present exemplary embodiment, an A3-sized sheet, an A4-sized sheet, and an A5-sized sheet based on the Japanese Industrial Standards (JIS) sheet sizes will be referred to as a first sheet, a second sheet, and a third sheet, respectively.

As illustrated in FIG. 2, the image forming apparatus 1 includes an environment sensor 23 and a sheet type detection sensor 24. The environment sensor 23 is an example of the environment detection unit that detects environment information about an area including the image forming apparatus 1, and according to the present exemplary embodiment, the environment information refers to temperatures and humidities of the installation environment of the image forming apparatus 1. The sheet type detection sensor 24 is an example of a type acquisition unit and allows the control unit 100 to acquire the type of the sheet by generating different signals for different types (type based on the material and thickness) of sheets S supported by the manual feed tray 10. This enables the control unit 100 to acquire grammages of the sheets S supported by the manual feed tray 10.

Further, while the case is described where the image forming apparatus 1 includes the sheet detection unit 25 to enable an automatic detection of a sheet length in the feed direction FD according to the present exemplary embodiment, this is not a limiting case and, for example, the user can manually input the size of a sheet to the operation unit 730. Further, while the case is described where the image forming apparatus 1 includes the environment sensor 23 to enable an automatic detection of environment information according to the present exemplary embodiment, this is not a limiting case and, for example, the user can manually input environment information to the operation unit 730. Further, while the case is described where the image forming apparatus 1 includes the sheet type detection sensor 24 to enable an automatic detection of a sheet type according to the present exemplary embodiment, this is not a limiting case and, for example, the user can manually input a sheet type to the operation unit 730. Even in this case, the control unit 100 can still acquire grammages of the sheets S supported by the manual feed tray 10.

[Side Regulation Units]

The pair of the first side regulation unit 70 and the second side regulation unit 80 are arranged on both sides of the sheets S placed on the manual feed tray 10 in the width direction W perpendicular to the feed direction FD of the sheets S and are brought into contact with sides of the sheets S in the width direction W to regulate the positions of the sheets S in the width direction W. The first side regulation unit 70 is an example of a regulation portion, is provided movable in the width direction W on the manual feed tray 10, and regulates the positions of the sheets S supported by the manual feed tray 10 in the width direction W. The second side regulation unit 80 is provided movable in the other width direction W in coordination with the first side regulation unit 70 and is brought into contact with the other side of the sheets S placed on the manual feed tray 10 in the width direction W. According to the present exemplary embodiment, the width directions W are directions perpendicular to the feed direction FD of the sheets S.

The first side regulation unit 70 includes a rack 71. Similarly, the second side regulation unit 80 includes a rack 81. The racks 71 and 81 engage with a pinion gear 90 and work together. This enables at least one of the first side regulation unit 70 and the second side regulation unit 80 to move in the corresponding width direction W, and according to the present exemplary embodiment, the first side regulation unit 70 and the second side regulation unit 80 are both movable synchronously in the width directions W of the sheets S. The racks 71 and 81 and the pinion gear 90 are provided on the opposite side in the manual feed tray 10 from the placement surface on which the sheets S are placed. Either the first side regulation unit 70 or the second side regulation unit 80 can be unmovably fixed. Further, the first side regulation unit 70 alone can be provided movable without the second side regulation unit 80.

The first side regulation unit 70 is provided with the first air-assisted separation unit 74 including the air blowing fan 72 as an example of an air blowing portion, a first air outlet 73*a*, a second air outlet 73*b*, and a communication passage 75. The air blowing fan 72 is rotated by an electric motor, and the rotation speed is controlled by the control unit 100. The control unit 100 increases the amount of fan airflow by increasing the rotation speed of the air blowing fan 72 and decreases the amount of fan airflow by decreasing the rotation speed of the air blowing fan 72. The communication passage 75 is a duct connecting the air blowing fan 72, the first air outlet 73*a*, and the second air outlet 73*b* together. The first air outlet 73*a* is disposed on the first side regulation unit 70, and blows air from the air blowing fan 72 to sheets S in the width direction W supported by the manual feed tray 10 to separate the sheets S. The second air outlet 73*b* is disposed upstream of the first air outlet 73*a* in the feed direction FD on the first side regulation unit 70, and blows air from the air blowing fan 72 to the sheets S in the width direction supported by the manual feed tray 10 to separate the sheets S. As described above, the air blowing fan 72 is driven to blow air f1 from the first air outlet 73*a* and the second air outlet 73*b* to one side of the sheets in a bundle on the manual feed tray 10. The air f1 from the air blowing fan 72 blowing to the side of the sheets S as separation air lifts upper sheets S in a bundle, and reduces the adhesion therebetween.

Similarly, the second side regulation unit 80 is provided with the second air-assisted separation unit 84 including the air blowing fan 82, a first air outlet 83*a*, a second air outlet 83*b*, and a communication passage 85. The air blowing fan 82 is rotated by an electric motor, and the rotation speed is controlled by the control unit 100. The control unit 100 increases the amount of fan airflow by increasing the rotation speed of the air blowing fan 82 and decreases the amount of fan airflow by decreasing the rotation speed of the air blowing fan 82. The communication passage 85 is a duct connecting the air blowing fan 82, the first air outlet 83*a*, and the second air outlet 83*b* together. The first air outlet 83*a* is disposed in the second side regulation unit 80, and blows air from the air blowing fan 82 to the other side of the sheets S in the other width direction W supported by the manual feed tray 10 to separate the sheets S. The second air outlet 83*b* is disposed upstream of the first air outlet 83*a* in the feed direction FD on the second side regulation unit 80, and blows air from the air blowing fan 82 to the sheets S in the other width direction W supported by the manual feed tray 10 to separate the sheets S. As described above, the air blowing fan 82 is driven to blow air f2 from the first air outlet 83*a* and the second air outlet 83*b* to the other side of the sheets in a bundle on the manual feed tray 10 opposite to the first side regulation unit 70. The air f2 from the air blowing fan 82 blowing to the other side of the sheets S as separation air, together with the air f1 blown from the opposite side, lifts upper sheets S in a bundle effectively, and reduces the adhesion therebetween. Similarly to the racks 71 and 81 and the pinion gear 90, the air blowing fans 72 and 82 are provided on the opposite side of the manual feed tray 10 from the placement surface on which the sheets S are placed.

When the manual feed unit 500 is selected and an operation of image formation is performed by a user, the sheet feeding from the manual feed unit 500 is started. In a case where the sheets S placed on the manual feed tray 10 are, for example, coated paper, the air blowing fans 72 and 82 operate. The air f1 and the air f2 are blown out of the first air outlet 73*a*, the second air outlet 73*b*, the first air outlet 83*a*, and the second air outlet 83*b* to the sides of the bundle of sheets in the width directions W.

In a predetermined time from the start of the air f1 and the air f2 blowing, upper sheets S with decreased adhesive force therebetween are fed by the pickup roller 502 to the pair of separation rollers consisting of the feed roller 503 and the retard roller 504. A single sheet S separated by the pair of separation rollers is conveyed to the pair of registration rollers 240 via a pair of conveyance rollers 506.

[Positions of Air Outlets]

The positions of the first air outlet 73*a* and the second air outlet 73*b* will now be described. FIG. 3 illustrates a state where A3-sized sheets S, which are the first sheets, are placed with their longer direction as the feed direction FD. The first air outlet 73*a* and the second air outlet 73*b* are arranged to face the A3-sized sheets S in the width direction W and blow air to one side of the sheets S.

Figure 4:
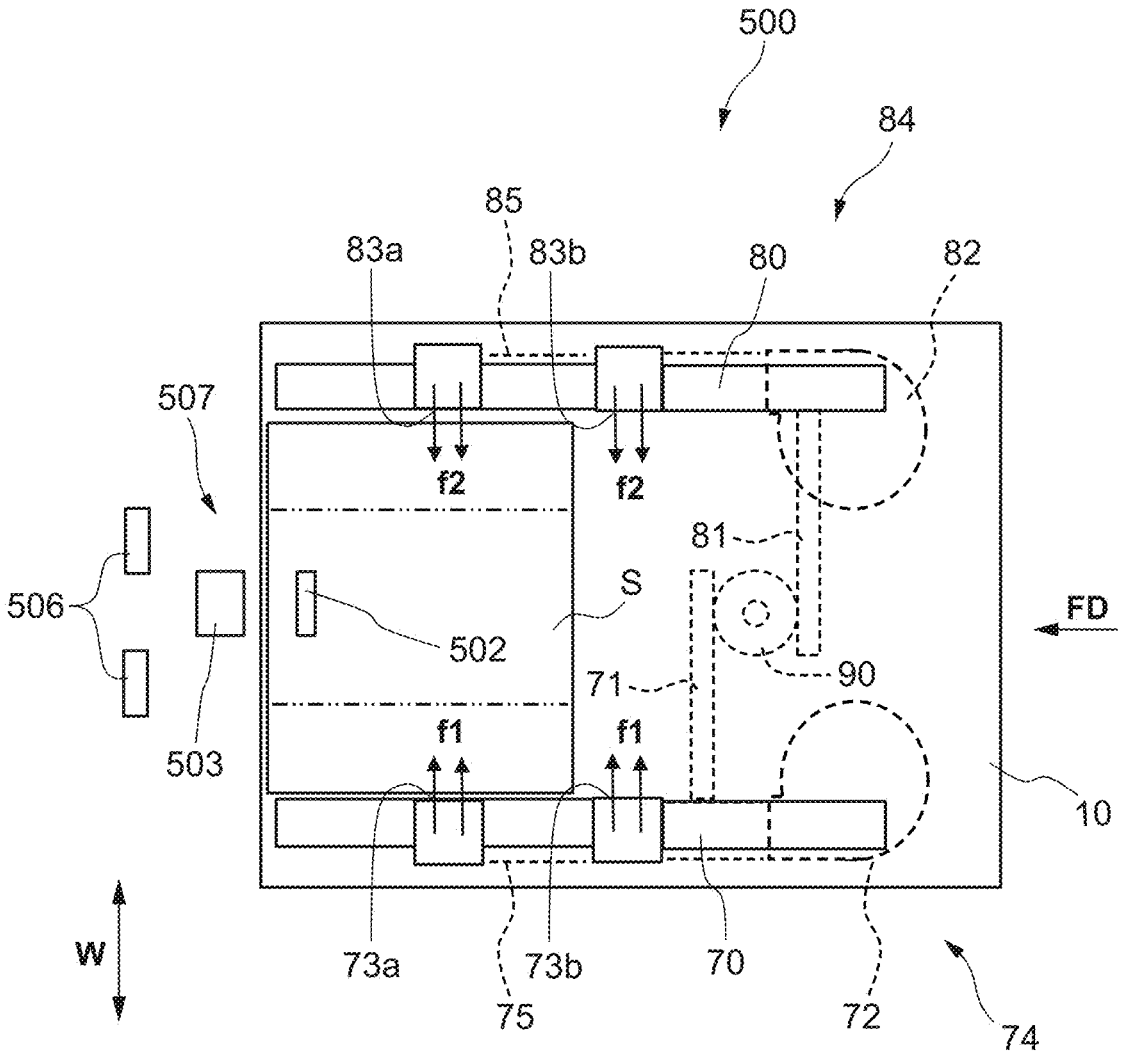
FIG. 4 is a plan view illustrating a state where A4-sized sheets are stacked on the manual feed unit according to the exemplary embodiment.

FIG. 4 illustrates a state where A4-sized sheets S, which are the second sheets, are placed with their shorter direction as the feed direction FD. The first air outlet 73*a* is disposed to face the A4-sized sheets S in the width direction W and blow air to the side of the sheets S. In contrast, the second air outlet 73*b* does not face the sheets S in the width direction W, so that blown air cannot be blown to the sheets S.

As described above, the manual feed unit 500 including the first air-assisted separation unit 74 and the second air-assisted separation unit 84 illustrated in FIG. 3 includes the four air outlets, and separation air is blown from all the four air outlets during a sheet separation. At this time, air is blown from all the four outlets to the sides of the A3-sized sheets S in FIG. 3, whereas air is blown from the two outlets (first air outlets 73*a* and 83*a*) arranged downstream in the feed direction FD to the sides of the A4-sized sheets S in FIG. 4. Thus, the number of the air outlets for blowing separation air to the sides of sheets is fewer in the case of A4-sized sheets placed on the manual feed tray rather than the case of A3-sized sheets, which results in reduced effect of loosening the adhesive force between the sheets S. According to the present exemplary embodiment, higher rotation speeds of the air blowing fans 72 and 82 for A4-sized sheets than those for A3-sized sheets increase the airflow as the separation air to facilitate stable sheet separation.

The adhesive force between sheets increases as their size is larger. This is because larger sheets have larger contact areas between the sheets. In contrast, the adhesive force between sheets decreases as their size is smaller. For example, the adhesive force between A5-sized sheets is weak, and the sheets can be conveyed without separation air. According to the present exemplary embodiment, in a case where A5-sized sheets are to be placed on the manual feed tray 10, the A5-sized sheets are placed as A5R-size sheets with their longer direction as the feed direction FD as indicated with the two-dot chain lines in FIG. 4. In this case, although the A4-sized and the A5R-sized sheets have the same length in the feed direction FD, the positions of the A4-sized and the A5R-sized sheets relative to the first side regulation unit 70 and the second side regulation unit 80 change, and the adhesive force between the A5R-sized sheets is smaller than that between the A4-sized sheets. Further, the control unit 100 is capable of identifying sheet sizes based on detection results of the sheet detection unit 25.

[Processing Procedure of Air-Assisted Separation Operation]

Figure 5:
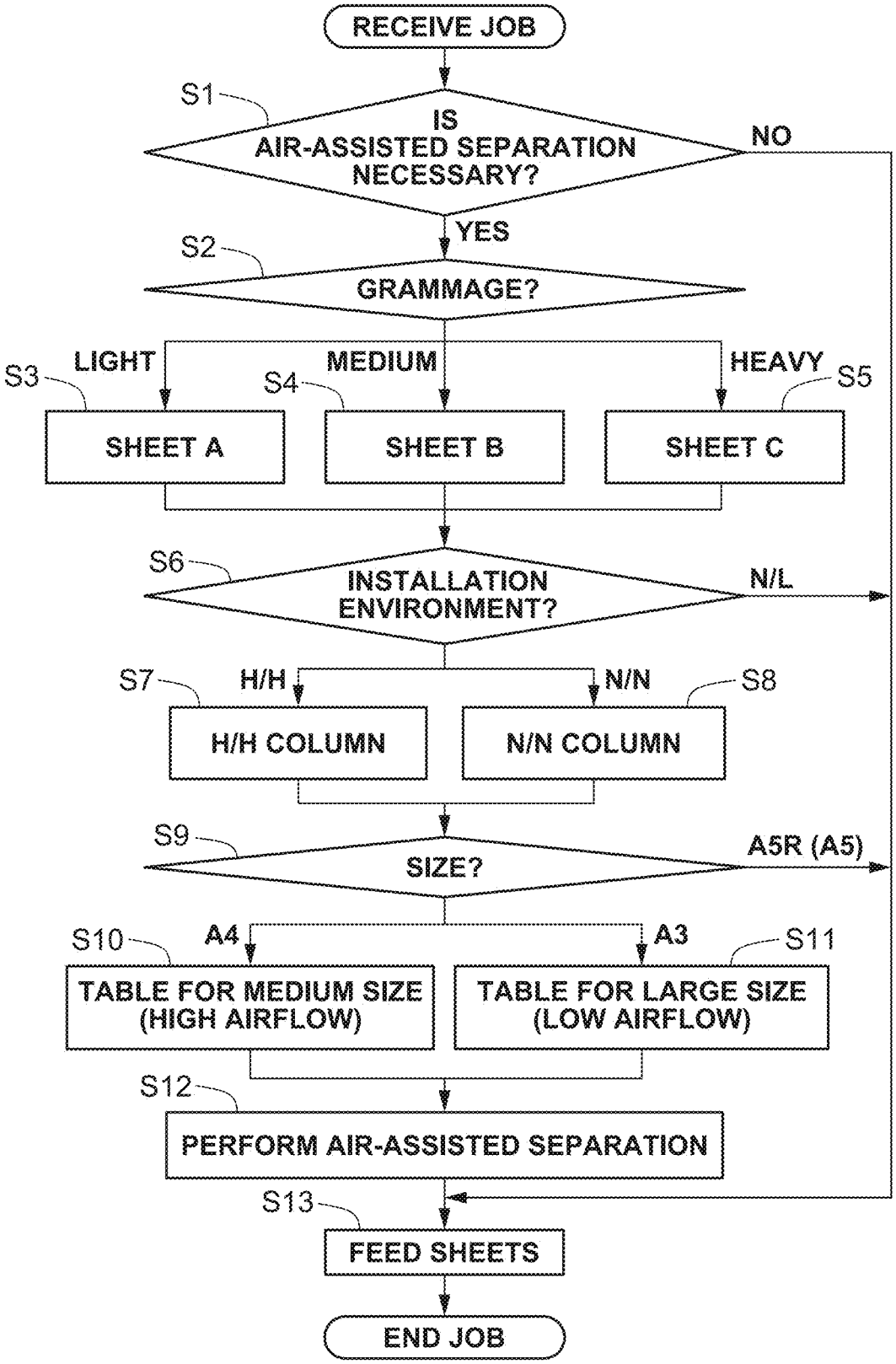
FIG. 5 is a flowchart illustrating an operation procedure for the manual feed unit of the image forming apparatus according to the exemplary embodiment.

A processing procedure of air-assisted separation operation using the manual feed unit 500 will now be described with reference to a flowchart in FIG. 5. First, the control unit 100 can select a first mode or a second mode and execute the selected mode. In the first mode, sheets are fed with an air-assisted separation being executed using the first air-assisted separation unit 74 and the second air-assisted separation unit 84. In the second mode, sheets are fed without the execution of air-assisted separation. In feeding, for example, since coated paper or water-resistant paper with high adhesive force involves air-assisted separation, the control unit 100 executes the first mode, whereas in feeding other types of paper, such as plain paper, no air-assisted separation is required, so that the control unit 100 executes the second mode.

In step S1, when receiving a job, the control unit 100 determines whether an air-assisted separation is to be performed in feeding a sheet from the manual feed unit 500. If the control unit 100 determines that the sheet type is plain paper and an air-assisted separation is unnecessary (NO in step S1), the processing proceeds to step S13. In step S13, the control unit 100 selects the second mode and executes a sheet feeding without executing an air-assisted separation, and the job is ended.

If the control unit 100 determines that the sheet type is coated paper or water-resistant paper with high adhesive force and an air-assisted separation is to be performed (YES in step S1), the processing proceeds to step S2. In step S2, the control unit 100 selects a table to be used in the air-assisted separation based on the sheet grammage. FIG. 6A illustrates an example of a table for an air-assisted separation for small-sized sheets, such as A5-sized sheets. FIG. 6B illustrates an example of a table for an air-assisted separation for medium-sized sheets, such as A4-sized sheets. FIG. 6C illustrates an example of a table for an air-assisted separation for large-sized sheets, such as A3-sized sheets. In each table, sheets A to C indicate differences in grammage. The sheet A corresponds to light-grammage sheets. The sheet B corresponds to medium-grammage sheets. The sheet C corresponds to heavy-grammage sheets. Further, in each table, duty ratios indicate the airflows of the air blowing fans 72 and 82, specifically, with 100% as the highest airflow and 0% as a stop. As to the duty ratios, linear interpolation can be performed with respect to environment information. For example, if the grammage is light (LIGHT in step S2), the processing proceeds to step S3. In step S3, the control unit 100 selects the sheet A in the tables. In a case where the grammage is medium (MEDIUM in step S2), the processing proceeds to step S4. In step S4, the control unit 100 selects the sheet B in the tables. If the grammage is heavy (HEAVY in step S2), the processing proceeds to step S5. In step S5, the control unit 100 selects the sheet C in the tables.

The grammage-based determination will now be described specifically with reference to the tables. A case where air is blown to A4-sized sheets will be described with reference to the table illustrated in FIG. 6B. The control unit 100 causes the amount of fan airflow (60%) from the air blowing fans 72 and 82 to be larger when the sheet grammage is in the second grammage (164 to 220) than that (40%) of when in the first grammage (up to 163).

In step S6, the control unit 100 acquires environment information about the installation environment. Predetermined ranges are set for three conditions, H/H (high temperature/high humidity), N/N (medium temperature/medium humidity), and N/L (medium temperature/low humidity), and the corresponding condition is selected as the environment information. Examples of temperatures and humidities include H/H (30° C./80%), N/N (23.5° C./50%), and N/L (23.5° C./15%). The adhesive force between sheets varies depending on the temperature and humidity, and the adhesive force in H/H is higher than those in the other environments. In N/L, the adhesive force is weak, and stable sheet supply is possible without executing an air-assisted separation.

N/N is an environment between H/H and N/L, and in this environment, the adhesive force is not as high as that in H/H, but sheets still adhere to each other, so that an air-assisted separation is performed.

If the control unit 100 determines that the installation environment is H/H (H/H in step S6), the processing proceeds to step S7. In step S7, the control unit 100 selects the H/H column in the table, whereas if the control unit 100 determines that the installation environment is N/N (N/N in step S6), the processing proceeds to step S8. In step S8, the control unit 100 selects the N/N column in the table. Through the foregoing processing, the control unit 100 changes the amount of fan airflow from the air blowing fans 72 and 82 based on the detection results with the environment sensor 23. If the control unit 100 determines that the installation environment is N/L (N/L in step S6), the control unit 100 determines that no air-assisted separation is performed, and the processing proceeds to step S13. In step S13, the control unit 100 executes a sheet feeding without executing an air-assisted separation, and the job is ended.

The determination based on the environment information will be described with reference to a table. A case where the medium humidity is 50%, and the low humidity is 15%, and air is blown to A3-sized sheets will be described with reference to the table illustrated in FIG. 6C. In this case, the amount of fan airflow rate (0%) from the air blowing fans 72 and 82 in a case where the detected humidity is a second humidity (15%), which is lower than a first humidity (50%), is smaller than the amount of fan airflow (40%) from the air blowing fans 72 and 82 with the first humidity. Further, a case where air is blown to A4-sized sheets will be described with reference to the table illustrated in FIG. 6B. In this case, the amount of fan airflow (0%) from the air blowing fans 72 and 82 in a case where the detected humidity is the second humidity (15%), which is lower than the first humidity (50%), is smaller than the amount of fan airflow (40% to 60%) from the air blowing fans 72 and 82 with the first humidity.

In step S9, the control unit 100 determines the size of the sheets to be fed. The control unit 100 can identify the actual sheet size or at least detect the sheet length in the feed direction FD without identifying a specific size of the sheet, such as A4 or A3. If the control unit 100 determines that the sheet size is A4 (A4 in step S9), the processing proceeds to step S10. In step S10, the control unit 100 selects the table for medium size (FIG. 6B). If the control unit 100 determines that the sheet size is A3 (A3 in step S9), the processing proceeds to step S11. In step S11, the control unit 100 selects the table for large size (FIG. 6C). In step S12, one of the sheets A to C and one of the H/H and N/N columns in the selected table are selected based on the previously selected result to determine the output amount of the air blowing fans 72 and 82, and an air-assisted separation is executed. The foregoing processing makes it possible to execute an air-assisted separation with a suitable amount of airflow based on the sheet type, size, and environment condition.

Consequently, if the sheets supported by the manual feed tray 10 are A3-sized sheets, the control unit 100 controls the amount of fan airflow from the air blowing fans 72 and 82 as a first airflow (80%) in executing an air-assisted separation with the first air-assisted separation unit 74 and the second air-assisted separation unit 84. If the sheets supported by the manual feed tray 10 are A4-sized sheets, the control unit 100 controls the amount of fan airflow from the air blowing fans 72 and 82 as a second airflow (100%), which is larger than the first airflow in executing an air-assisted separation with the first air-assisted separation unit 74 and the second air-assisted separation unit 84. Specifically, the control unit 100 switches the amount of fan airflow from the air blowing fans 72 and 82 between the first airflow (80%) and the second airflow (100%) based on the detection results with the sheet detection unit 25. While the first airflow is 80% and the second airflow is 100% according to the present exemplary embodiment described above, this is not a limiting case, and the first and second airflows can be any other numerical values as long as the second airflow is larger than that of the first airflow.

While air is blown to the sides of sheets to loosen the adhesion between the sheets, the adhesive force between A5R-sized sheets is not strong and no sheet separation by blowing air is performed. Air blown to sheets with an unsuitable amount of fan airflow for the size and grammage of the sheets in an air-assisted separation, specifically a large amount of airflow, causes excessive operating noise and/or power consumption. Thus, in step S9, if the control unit 100 determines that the sheet size is A5R or A5, since the adhesive force between the sheets is weak, the processing proceeds to the feeding operation in step S13 without executing an air-assisted separation. Specifically, when the sheets supported by the manual feed tray 10 are A5R-sized sheets having the same length as A4-sized sheets in the feed direction FD, one side facing the first air outlet 73*a*, and being shorter in the width direction W than that of A4-sized sheets, the control unit 100 stops the air blowing from the air blowing fans 72 and 82.

As described above, with the manual feed unit 500 according to the present exemplary embodiment, if the sheets are A3-size, the amount of fan airflow from the air blowing fans 72 and 82 is controlled to the first airflow (80%), whereas if the sheets are A4-size, the amount of fan airflow is controlled to the second airflow (100%), which is larger than the first airflow. This makes it possible to set appropriate amounts of fan airflow for sheets with different lengths in the feed direction FD. Consequently, an appropriate amount of air is blown to the sides of sheets in an air-assisted separation, which results in a stable sheet separation until the last sheet stacked on the manual feed tray 10. This can solve the issues of excessive operating noise and/or power consumption caused by a too large amount of fan airflow and insufficient sheet separation caused by a too small amount of fan airflow.

Further, with the image forming apparatus 1 according to the present exemplary embodiment, if the sheet size is determined to be A5R or A5, since the adhesive force between the sheets is weak, the processing proceeds to the feeding operation without executing an air-assisted separation. This prevents excessive operating noise and power consumption. In some embodiments, an air-assisted separation can be executed before the feeding operation process.

While specific numerical values are described above according to the exemplary embodiment, the numerical values are not limiting values. For example, the adhesion between sheets depends on the media type and the environmental condition, such as the size, dimension, grammage of the sheets and the humidity, and the numerical values can be determined based on each condition.

Further, while the case is described above where the sheet detection unit 25 is used to detect sheet lengths in the feed direction FD according to the exemplary embodiment, this is not a limiting case. For example, the user can input information to the operation unit 730. In this case, the operation unit 730 is an example of an input unit, and information about the length of sheets supported by the manual feed tray 10 in the feed direction FD is input to the operation unit 730. The information about the length of sheets in the feed direction FD can be a length or the size of the sheets, such as A3 or A4. In any case, the control unit 100 is capable of performing the determination in step S9 in FIG. 5 based on the input information. Specifically, the control unit 100 switches the amount of fan airflow from the air blowing fans 72 and 82 between the first airflow (80%) and the second airflow (100%) based on the information input to the operation unit 730.

While the present disclosure has described exemplary embodiments, it is to be understood that some embodiments are not limited to the disclosed exemplary embodiments. The scope of the following claims is to be accorded the broadest interpretation so as to encompass all such modifications and equivalent structures and functions.

This application claims priority to Japanese Patent Application No. 2023-169938, which was filed on Sep. 29, 2023 and which is hereby incorporated by reference herein in its entirety.

What is claimed is:

1. A sheet feeding apparatus comprising:

a support portion configured to support a sheet;

a feed unit configured to feed the sheet supported by the support portion;

an air blowing unit including an air blowing portion configured to blow air, a first air outlet configured to blow the air blown from the air blowing portion in a width direction to the sheet supported by the support portion, and a second air outlet disposed upstream of the first air outlet in a feed direction and configured to blow the air blown from the air blowing portion in the width direction to the sheet supported by the support portion; and a control unit configured to control an amount of fan airflow from the air blowing portion in executing air blowing by the air blowing unit, wherein the first air outlet is disposed so as to face the sheet to blow the air to the sheet in a case where the sheet supported by the support portion is a first sheet and a second sheet shorter than the first sheet in the feed direction, wherein the second air outlet is disposed so as to face the sheet to blow the air to the sheet in a case where the sheet supported by the support portion is the first sheet and is disposed so as not to face the sheet in a case where the sheet supported by the support portion is the second sheet, and wherein in a case where the sheet supported by the support portion is the first sheet, the control unit controls the amount of fan airflow from the air blowing portion to a first airflow in executing air blowing by the air blowing unit, whereas in a case where the sheet supported by the support portion is the second sheet, the control unit controls the amount of the fan airflow from the air blowing portion to a second airflow larger than the first airflow in executing air blowing by the air blowing unit.

2. The sheet feeding apparatus according to claim 1, wherein in a case where the sheet supported by the support portion is a third sheet having the same length as the second sheet in the feed direction, facing the first air outlet, and being shorter in the width direction than the second sheet, the control unit stops the air blowing from the air blowing portion.

3. The sheet feeding apparatus according to claim 1, wherein the air blowing portion includes a fan, and wherein the control unit increases the amount of fan airflow by increasing a rotation speed of the fan and decreases the amount of fan airflow by decreasing the rotation speed of the fan.

4. The sheet feeding apparatus according to claim 1, further comprising a sensor configured to detect the sheet supported by the support portion and output a detection result that varies based on whether the detected sheet is the first sheet or the second sheet, wherein the control unit switches the amount of fan airflow from the air blowing portion between the first airflow and the second airflow based on the detection result of the sensor.

5. The sheet feeding apparatus according to claim 1, further comprising an operation unit to which information about a length of the sheet supported by the support portion in the feed direction is input, wherein the control unit switches the amount of fan airflow from the air blowing portion between the first airflow and the second airflow based on the information input to the operation unit.

6. The sheet feeding apparatus according to claim 1, wherein the control unit changes the amount of fan airflow from the air blowing portion based on a detection result of a sensor configured to detect environment information about an area where the sheet feeding apparatus is installed.

7. The sheet feeding apparatus according to claim 6, wherein the environment information is a humidity, and wherein the control unit controls the amount of fan airflow from the air blowing portion in executing the air blowing to the first sheet supported by the support portion so that the amount of fan airflow is smaller in a case where the detected humidity is a second humidity lower than a first humidity, than an amount of fan airflow at the first humidity.

8. The sheet feeding apparatus according to claim 6, wherein the environment information is a humidity, and wherein the control unit controls the amount of fan airflow from the air blowing portion in executing the air blowing to the second sheet supported by the support portion so that the amount of fan airflow is smaller in a case where the detected humidity is a second humidity lower than a first humidity, than an amount of fan airflow at the first humidity.

9. The sheet feeding apparatus according to claim 1, wherein the control unit controls the amount of fan airflow from the air blowing portion in executing the air blowing to the second sheet supported by the support portion so that the amount of fan airflow is larger in a case where a sheet grammage acquired by a sensor configured to acquire a type of the sheet supported by the support portion is a second grammage higher than a first grammage, than an amount of fan airflow at the first grammage.

10. The sheet feeding apparatus according to claim 1, wherein the support portion is configured to be opened or closed by being pivoted relative to a housing, is configured to be moved between a closed position and an opened position, and supports the sheet at the opened position.

11. An image forming apparatus comprising:

the sheet feeding apparatus according to claim 1; and an image forming unit configured to for an image on a sheet fed by the sheet feeding apparatus.

12. A sheet feeding apparatus comprising:

a support portion configured to support a sheet;

a feed unit configured to feed the sheet supported by the support portion;

an air blowing unit including an air blowing portion configured to blow air, a first air outlet configured to blow the air blown from the air blowing portion in a width direction to the sheet supported by the support portion, and a second air outlet disposed upstream of the first air outlet in a feed direction and configured to blow the air blown from the air blowing portion in the width direction to the sheet supported by the support portion; and a control unit configured to control revolutions per minute of the air blowing portion in executing air blowing by the air blowing unit, wherein the first air outlet is disposed so as to face the sheet to blow the air to the sheet in a case where the sheet supported by the support portion is a first sheet and a second sheet shorter than the first sheet in the feed direction, wherein the second air outlet is disposed so as to face the sheet to blow the air to the sheet in a case where the sheet supported by the support portion is the first sheet and is disposed so as not to face the sheet in a case where the sheet supported by the support portion is the second sheet, and wherein in a case where the sheet supported by the support portion is the first sheet, the control unit controls the revolutions per minute of the air blowing portion to a first revolutions-per-minute value in executing air blowing by the air blowing unit, whereas in a case where the sheet supported by the support portion is the second sheet, the control unit controls the revolutions per minute of the air blowing portion to a second revolutions-per-minute value larger than the first revolutions-per-minute value.

* * * * *